United States Patent [19]

Guesnet et al.

[11] Patent Number: 4,880,552

[45] Date of Patent: Nov. 14, 1989

[54] WATER-SOLUBLE ADDITIVES HAVING EXTREME PRESSURE EFFECT FOR AQUEOUS FUNCTIONAL FLUIDS, FUNCTIONAL FLUIDS AND CONCENTRATED AQUEOUS COMPOSITIONS CONTAINING THE ADDITIVES

[75] Inventors: Patrice Guesnet, Pau, France; Tetsuchi Kawamura, Tokyo, Japan; Gérard Savin, Serre-Castet, France; Sabine Poncet, Pau, France; Charles Castera, Sainte-Suzanne, France

[73] Assignee: Societe Nationale Elf Aquitaine (Production), France

[21] Appl. No.: 184,425

[22] Filed: Apr. 21, 1988

[30] Foreign Application Priority Data

Apr. 24, 1987 [FR] France ..... 87 05778

[51] Int. Cl.[4] ..... C10M 135/26

[52] U.S. Cl. ..... 252/34; 252/39; 252/41; 252/48.6; 252/49.3; 252/49.5; 568/22; 72/42

[58] Field of Search ..... 252/49.5, 49.3, 48.6, 252/34, 41, 39; 568/22; 72/42

[56] References Cited

U.S. PATENT DOCUMENTS

| | | | |
|---|---|---|---|
| 2,520,748 | 8/1950 | Vaughan et al. | 252/48.6 |
| 2,649,416 | 8/1953 | Richter et al. | 252/48.6 |
| 2,691,000 | 10/1954 | Elliott | 252/48.6 |
| 2,794,049 | 5/1957 | Thompson | 568/22 |
| 2,815,368 | 12/1957 | Matuszak | 252/48.6 |
| 2,845,390 | 7/1958 | Kerschner | 252/48.6 |
| 3,041,283 | 6/1962 | Calhoun et al. | 252/48.6 |
| 3,278,434 | 10/1966 | Hoffman | 252/48.6 |
| 4,036,709 | 7/1977 | Harbulak | 204/43 T |
| 4,248,723 | 2/1981 | Schmidt | 252/48.6 |
| 4,250,046 | 2/1981 | Przybylinski | 252/49.3 |
| 4,322,214 | 3/1982 | Wilser et al. | 8/582 |
| 4,490,307 | 12/1984 | Klenk | 558/436 |
| 4,659,490 | 4/1987 | Louthan et al. | 252/493 |

OTHER PUBLICATIONS

Chemical Abstracts, vol. 90, p. 38, 1979, Heat Stabilizers For Bromine Compound-Containing Styrene Polymers, Abstract No. 122566t.

Journal of the American Society of Lubrication Engineers, vol. 33, No. 6, pp. 291-298, Jun. 1977. "Investigations of the Activity of Cutting Oil Additives".

Smalheer & Smith, "Lubricating Additives", Section 1, "Chemistry of Additives", 1967.

*Primary Examiner*—William R. Dixon, Jr.
*Assistant Examiner*—Ellen M. McAvoy
*Attorney, Agent, or Firm*—Stevens, Davis, Miller & Mosher

[57] ABSTRACT

This invention relates to the use of water-soluble 3-mercaptopropionic acid disulphide salts as extreme pressure additives for aqueous functional fluids.

These salts may be prepared by the oxidation of 3-mercaptopropionic acid followed by bringing the disulphide obtained into contact with an organic or inorganic base.

Functional fluids are used during industrial operations such as, for example, the machining of metals.

22 Claims, No Drawings

WATER-SOLUBLE ADDITIVES HAVING EXTREME PRESSURE EFFECT FOR AQUEOUS FUNCTIONAL FLUIDS, FUNCTIONAL FLUIDS AND CONCENTRATED AQUEOUS COMPOSITIONS CONTAINING THE ADDITIVES

FIELD OF THE INVENTION

The present invention relates to extreme pressure additives for aqueous functional fluids as well as to functional fluids and concentrated aqueous compositions containing the additives.

BACKGROUND OF THE INVENTION

Many industrial operations such as machining of metals, drilling, grinding, turning, milling, rolling, wire drawing or swaying require so-called functional fluids.

The role of these fluids is to decrease cutting forces, to cool the workpiece to obtain good dimension characteristics, to remove the chips from the cutting zone, to impart a good surface funish to the workpiece and to extend the life of tools.

Water is the best cooling agent because its specific heat, heat of vaporization and thermal conductivity are high. At the same time, it is the most economical and most harmless cooling agent towards the environment. However, the use of aqueous functional fluids is becoming common. These aqueous functional fluids may be true aqueous solutions of different additives in water which are called synthetic fluids, or alternatively, microemulsions which are called semisynthetic fluids. Semisynthetic fluids contain, in addition to water, mineral oils and surfactants.

For high pressure machining operations, the use of aqueous functional fluids has not yet found a satisfactory solution.

In these operations, the friction between metal surfaces becomes very high; and it is necessary to use extreme pressure additives. The role of these additives consists in forming a protective layer on the metal surfaces. This protective layer film prevents a work-piece from being seized, or even worse, becoming welded to the working tool.

The most commonly used among these extreme pressure additives are sulphur-containing additives because they are the most effective. Contact with hot metal surfaces gives rise to the decomposition of sulphur-containing products and to the formation of a protective metal sulphide layer which is continually renewed.

The sulphur-containing products used as extreme pressure additives in lubricants based on mineral oils or emulsions are dialkyl polysulphides, sulphur-containing polyisobutenes and sulphur-containing fatty acid esters. All these products are sparingly soluble or insoluble in water.

Attempts were made to overcome this disadvantage by using extreme pressure additives which are soluble in water.

The article by R.W. MOULD of British Petroleum Co. Ltd. (Journal of the American Society of Lubrication Engineers, 33(6)291–298 (1977)) examines the efficiency of a number of water-soluble halogenated or sulphur-containing products as extreme pressure additives for aqueous fluids. The efficacy of halogenated, generally chlorinated, products is very low. The sulphur-containing products studied, such as sodium salts of thiosalicylic acid, or 2-mercaptopropionic acid, 2,2'-dithiodibenzoic acid, 2,2'-dithiodipropionic acid, disodium-L-cystine and disodium dithiodiglycolate are not very stable and promote development of bacteria and release of hydrogen sulphide.

To stabilize them, the formulations of these products require addition of large quantities of bactericidal agents which are commonly used in emulsions, but are generally excluded from functional fluids.

U.S. Pat. No. 4,250,046 describes the use of diethanol disulphide as extreme pressure additive. However, this product is incompatible with many additives which are commonly used in the formulation of semisynthetic fluids.

We have now found a water-soluble, effective and stable extreme pressure additive.

SUMMARY OF THE INVENTION

The extreme pressure additive for aqueous functional fluids according to the invention consists of a water-soluble salt of 3-mercaptopropionic acid disulphide or 3,3'-dithiodipropionic acid $(SCH_2CH_2CO_2H)_2$. Water-soluble salt means any inorganic or organic salt the solubility of which in water at room temperature is at least 0.01%. The preferred salts are those with a solubility of at least 0.1%.

DETAILED DESCRIPTION OF THE INVENTION 3-mercaptopropionic acid disulphide is a known compound which can readily be prepared by oxidation of 3-mercaptopropionic acid by sulphur or conventional oxidizing agent such as hydrogen peroxide.

The salts used in accordance with this invention are obtained in a conventional manner by neutralizing the disulphide, in an aqueous medium, with an organic or inorganic base. Thus, it is possible to use alkali metal or alkaline earth metal oxides, hydroxides or carbonates, liquid ammonia or organic nitrogenous bases. As nitrogenous organic bases yielding water-soluble salts, more particular mention can be made of the mono-, di- or trialkylamines and cycloalkylamines whose total number of carbon atoms is not more than 8 (preferably from 1 to 6), as well as the alkylamines having at least one alkyl radical which brings one or more hydrophilic groups such as OH, COOH or poly(oxyethylene and/or propylene). Mono-, di- or triethanolamines are advantageously used.

The aqueous solutions of the salts according to the invention are perfectly stable and can easily be stored without the release of hydrogen sulphide, even in a neutral medium having a pH of 7. If desired, the salts from inorganic bases can also be isolated in form of crystals.

The salts according to the invention are incorporated into the aqueous fluids at a gravimetric concentration ranging from 0.01% to 20% and preferably from 0.1% to 10%.

They may be used alone; however, they are generally used mixed with other common additives for aqueous fluids. Among these additives, there may be mentioned additives having antiwear, antirust and antifoam effects.

The aqueous functional fluids are synthetic or semisynthetic in nature. Synthetic fluids are true aqueous solutions of different additives in water. Their lubricating effect may be improved by adding polyglycols such as polyethylene glycols, polypropylene glycols or their copolymers.

Semisynthetic fluids are microemulsions containing a mineral or synthetic oil and a surfactant. The oil improves the lubricating properties of the aqueous fluid.

Because the salts of 3-mercaptopropionic acid disulphide are perfectly stable in an aqueous medium, it is possible to store them in the form of concentrated mixtures of additives which are diluted when used. These concentrates contain between 1% and 50% by weight, and preferably betweein 15% and 35%, of 3-mercaptopropionic acid disulphide. They also optionally contain other common additives such as antirust, antiwear and antifoam additives, surfactants, polyglycols or mineral or synthetic oils.

The efficacy of the additives according to the invention is assessed by testing on a 4-ball machine by the so-called 10-point test (ASTM standard D 2783).

A 4-ball machine test comprises 10 successive tests in which one ball, which is fixed in a chuck, rotates for 10 seconds against three balls held in a cradle filled with the extreme pressure fluid to be tested. By a system of weights, the three balls are pressed with an increasing force, from one test to the following, against the rotating ball. The weights progress geometrically.

In each test, the diameter of the scars observed on the three stationary balls is determined and a curve A is plotted on a logarithmic scale which gives the diameter of the scars as a function of the load applied. SEIZING (last load before seizing) is the load above which curve A deviates from an ideal line which is called the HERTZ line. It corresponds to the presence of a few weld points in contact between the balls. The scar or the wear diameter increases all of a sudden. WELDING (or weld load) is the load above which the 4 balls are welded to one another preventing the upper ball from rotating against the three others. MHL (maximum HERTZ load) is a dimensionless coefficient based on the determination of scars formed by the upper ball against the three stationary lower balls. The higher this coefficient, which has no real physical meaning, the better the oil tested is considered to be from the extreme pressure point of view.

EXAMPLES

The following examples illustrate the invention without, however, limiting it. The salts utilized are obtained and used in the form of aqueous solutions prepared as in the following typical example:

Typical preparation

Into a stirred reactor, 1050 g (5 moles) of 3-mercaptopropionic acid disulphide are dissolved in 1590 ml of water, then 610 g (10 moles) of pure monoethanolamine are added slowly. The solution thus obtained which contains about 50% of di(monoethanolamine) 3,3'-dithiodipropionate can be used such as it is or in diluted form.

Example I

Diethanolamine salt of 3-mercaptopriopionic acid disulphide (DEA DAM3P)

This salt is incorporated at various concentrations into a synthetic fluid (aqueous solution) containing 5% of ELF XT 6720 or into a semisynthetic fluid (microemulsion) containing 5% of ELF TX 6760.

ELF XT 6720 and 6760 are commercial additive concentrates which impart good lubricating properties (lubricity, anti-corrosion properties and the like) to water.

XT 6720 is a water-soluble concentrate containing polyglycols.

XT 6760 is a microemulsifiable concentrate especially containing a surfactant and a mineral oil.

| Additive concentrate | % Sulphur originating from DEA DAM3P | 4-Ball machine test results (so-called 10 point test) | | |
|---|---|---|---|---|
| | | SEIZING | WELDING | MHL |
| XT 6720 (5%) | 0 | 80 daN | 126 daN | 34 |
| XT 6720 (5%) | 0.15 | 80 daN | 160 daN | 37.6 |
| XT 6720 (5%) | 0.5 | 80 daN | 400 daN | 74.0 |
| XT 6720 (5%) | 1 | 80 daN | 400 daN | 78.1 |
| XT 6760 (5%) | 0 | 80 daN | 126 daN | 32 |
| XT 6760 (5%) | 0.15 | 80 daN | 160 daN | 38.6 |
| XT 6760 (5%) | 0.5 | 80 daN | 400 daN | 74.7 |
| XT 6760 (5%) | 1 | 100 daN | 500 daN | 77.6 |

The addition of DEA DAM3P into a conventional commercial formulation enables the extreme pressure properties of the latter to be improved significantly. (MHL increasing from 32 or 34 to 77–78.)

Example 2

Example 1 is repeated but with the monoethanolamine salt (MEA DAM3P).

| Additive concentrate | % Sulphur originating from MEA DAM3P | 4-Ball machine test results | | |
|---|---|---|---|---|
| | | SEIZING | WELDING | MHL |
| XT 6720 (5%) | 0 | 80 daN | 126 daN | 34 |
| XT 6720 (5%) | 0.15 | 80 daN | 160 daN | 38 |
| XT 6720 (5%) | 0.5 | 80 daN | 400 daN | 73.2 |
| XT 6720 (5%) | 1 | 100 daN | 500 daN | 79.0 |
| XT 6760 (5%) | 0 | 80 daN | 126 daN | 32 |
| XT 6760 (5%) | 0.15 | 80 daN | 160 daN | 38.7 |
| XT 6760 (5%) | 0.5 | 80 daN | 400 daN | 74.5 |
| XT 6760 (5%) | 1 | 100 daN | 500 daN | 78.6 |

Example 3

Example 1 is repeated but with the ammonium salt ($NH_4$ DAM3P).

| Additive concentrate | % Sulphur originating from $NH_4$ DAM3P | 4-Ball machine test results | | |
|---|---|---|---|---|
| | | SEIZING | WELDING | MHL |
| XT 6720 (5%) | 0 | 80 daN | 126 daN | 34 |
| XT 6720 (5%) | 0.15 | 80 daN | 160 daN | 37.7 |
| XT 6720 (5%) | 0.5 | 80 daN | 400 daN | 70.9 |
| XT 6720 (5%) | 1 | 80 daN | 400 daN | 75.5 |
| XT 6760 (5%) | 0 | 80 daN | 126 daN | 32 |
| XT 6760 (5%) | 0.15 | 80 daN | 160 daN | 37.9 |
| XT 6760 (5%) | 0.5 | 80 daN | 400 daN | 71 |
| XT 6760 (5%) | 1 | 80 daN | 400 daN | 75.4 |

Example 4

Example 1 is repeated but with the sodium salt (Na DAM3P).

| Additive concentrate | % Sulphur originating from Na DAM3P | 4-Ball machine test results | | |
|---|---|---|---|---|
| | | SEIZING | WELDING | MHL |
| XT 6720 (5%) | 0 | 80 daN | 126 daN | 34 |
| XT 6720 (5%) | 0.15 | 80 daN | 140 daN | 37.3 |
| XT 6720 (5%) | 0.5 | 80 daN | 400 daN | 72.7 |

-continued

| Additive concentrate | % Sulphur originating from Na DAM3P | 4-Ball machine test results SEIZING | WELDING | MHL |
|---|---|---|---|---|
| XT 6720 (5%) | 1 | 80 daN | 400 daN | 75.5 |
| XT 6760 (5%) | 0 | 80 daN | 126 daN | 32 |
| XT 6760 (5%) | 0.15 | 80 daN | 160 daN | 38.1 |
| XT 6760 (5%) | 0.5 | 80 daN | 400 daN | 73.5 |
| XT 6760 (5%) | 1 | 80 daN | 400 daN | 76.0 |

Example 5

Example 1 is repeated but with the calcium salt (Ca DAM3P).

| Additive concentrate | % Sulphur originating from Ca DAM3P | 4-Ball machine test results SEIZING | WELDING | MHL |
|---|---|---|---|---|
| XT 6720 (5%) | 0 | 80 daN | 126 daN | 34 |
| XT 6720 (5%) | 0.15 | 80 daN | 160 daN | 37.7 |
| XT 6720 (5%) | 0.50 | 80 daN | 400 daN | 71.9 |
| XT 6760 (5%) | 0 | 80 daN | 126 daN | 32 |
| XT 6760 (5%) | 0.15 | 80 daN | 160 daN | 38.4 |
| XT 6760 (5%) | 0.50 | 80 daN | 400 daN | 72.2 |

Example 6

The diethanolamine salt of 3-mercaptopropionic acid disulphide (DEA DAM3P) is used. A polyethylene glycol having an average molar mass of 400 (called PEG 400) is incorporated into the aqueous phase to improve the lubricating properties thereof.

| Additives | % Sulphur originating from DEA DAM3P | 4-Ball machine test results SEIZING | WELDING | MHL |
|---|---|---|---|---|
| PEG 400 (12%) | 0 | 200 daN | 20 daN | 28 |
| PEG 400 (12%) | 0.5 | 250 daN | 50 daN | 45 |

Example 7

Using the same salt as above (DEA DAM3P), the lubricating properties are improved by adding polypropylene glycol having an average molar mass of 425 (called PPG 425).

| Additives | % Sulphur originating from DEA DAM3P | 4-Ball machine test results SEIZING | WELDING | MHL |
|---|---|---|---|---|
| PPG 425 (12%) | 0 | 126 daN | 13 daN | 14 |
| PPG 425 (12%) | 0.1 | 126 daN | 32 daN | 29 |
| PPG 425 (12%) | 0.5 | 200 daN | 40 daN | 38 |

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. In a method of machining metals in the presence of an aqueous functional fluid containing an extreme pressure additive comprising incorporating a water-soluble salt into synthetic or semisynthetic fluid wherein the improvement is a water-soluble salt of 3-mercaptopropionic acid disulphide.

2. The method according to claim 1, wherein the water-soluble salt is an alkali metal or alkaline earth metal salt.

3. The method according to claim 1, wherein the salt is formed with liquid ammonia or an organic nitrogenous base.

4. The method according to claim 3, wherein the organic nitrogenous base is mono-, di- or trialkylamines or cycloalkylamines with a total number of carbon atom not more than 8, and alkylamines with at least one alkyl radical having one or more hydrophilic groups.

5. Method according to claim 4, wherein the nitrogenous organic base is mono- di- or triethanolamine.

6. An aqueous functional fluid comprising 0.01% to 20% by weight of a water-soluble salt according to claim 1.

7. Method according to claim 1, wherein use is made of an aqueous functional fluid comprising 0.1% to 10% by weight of a water-soluble salt according to claim 1.

8. Method according to claim 6, wherein the aqueous functional fluid further comprises at least one additive having antiwear, antirust and antifoam effects.

9. Method according to claim 6, wherein the aqueous functional fluid further comprises a polygycol.

10. The method according to claim 9, wherein the polyglycol is polyethylene glycol, polypropylene glycol or their copolymers.

11. Method according to claim 6, wherein the aqueous functional fluid further comprises a surfactant and a mineral or synthetic oil in the form of a microemulsion.

12. An additive having extreme pressure effect for aqueous functional fluids, comprising a water-soluble salt of 3-mercaptopropionic acid disulphide with an organic nitrogenous base selected from mono-, di- or trialkylamines or cycloalkylamines with a total number of carbon atoms not more than 8, and alkylamines with at least one alkyl radical having one or more hydrophilic groups.

13. The additive according to claim 12, wherein the nitrogenous organic base is mono-, di- or triethanolamine.

14. The aqueous functional fluid according to claim 12 comprising 0.01% to 20% by weight of a water-soluble salt.

15. The aqueous functional fluid according to claim 12 comprising 0.1% to 10% by weight of a water-soluble salt.

16. The aqueous functional fluid according to claim 14, further comprising at least one additive having antiwear, antirust and antifoam effects.

17. The aqueous functional fluid according to claim 14, further comprising a polyglycol.

18. The aqueous functional fluid according to claim 17, wherein the polyglycol is polyethylene glycol, polypropylene glycol or their copolymers.

19. The aqueous function fluid according to claim 14, further comprising a surfactant and a mineral or synthetic oil in the form of a microemulsion.

20. A concentrated aqueous composition comprising 1 % to 50 % by weight of a water-soluble salt according to claim 12.

21. The concentrated aqueous composition according to claim 20, comprising 15 % to 35 % by weight of water-soluble salt.

22. The aqueous composition according to claim 20, further comprising at least one additive having antiwear, antirust or antifoam effects; polyglycols; surfactants and mineral or synthetic oils.

* * * * *